United States Patent [19]

Dykes

[11] 4,297,861

[45] Nov. 3, 1981

[54] LOCK COVER

[76] Inventor: James R. Dykes, 540 E. 60th St., Savannah, Ga. 31405

[21] Appl. No.: 93,739

[22] Filed: Nov. 13, 1979

[51] Int. Cl.[3] ..... E05B 67/38

[52] U.S. Cl. ..... 70/55; 70/455

[58] Field of Search ..... 70/54, 55, 56, 455, 70/417; 206/521; 150/0.5, 52 R

[56] References Cited

U.S. PATENT DOCUMENTS

| | | | |
|---|---|---|---|
| 104,441 | 6/1870 | Gale . | |
| 1,662,612 | 3/1928 | Junkunc | 70/55 |
| 2,541,638 | 2/1951 | Clevett . | |
| 3,848,440 | 11/1974 | Manuel . | |
| 3,858,419 | 1/1975 | Hampton | 70/55 |
| 3,983,725 | 10/1976 | Manuel . | |

FOREIGN PATENT DOCUMENTS

| | | |
|---|---|---|
| 154804 | 10/1938 | Austria . |
| 395613 | 5/1924 | Fed. Rep. of Germany . |

*Primary Examiner*—Robert L. Wolfe

*Attorney, Agent, or Firm*—Wellington M. Manning, Jr.; Luke J. Wilburn, Jr.

[57] ABSTRACT

A cover for a padlock including a top cover portion having a top wall, side walls and end walls, the top wall defining shackle leg receiving openings, and the top and side walls having a generally U-shaped protrusion therealong to permit expansion and contraction with size variation of the padlock. A bottom portion of the lock cover includes a bottom wall, side walls and end walls that are removably connectable to the top cover portion, the bottom wall having an elongated membrane therein to receive a key and having shoulders to hold the lock body out of contact with the bottom wall. Side walls of the bottom cover portion have a generally U-shaped protrusion therealong to permit expansion and contraction.

8 Claims, 6 Drawing Figures

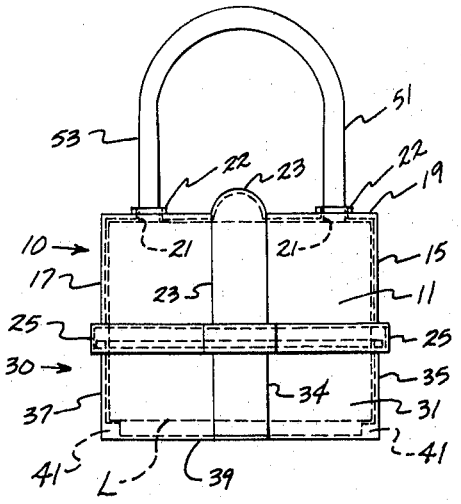
Fig. 1.
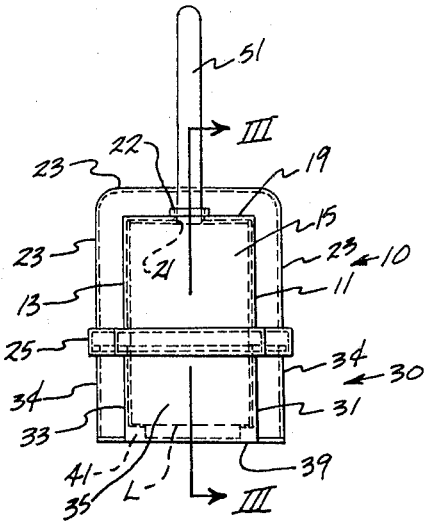
Fig. 2.
Fig. 6.
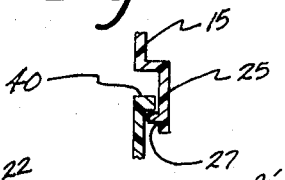
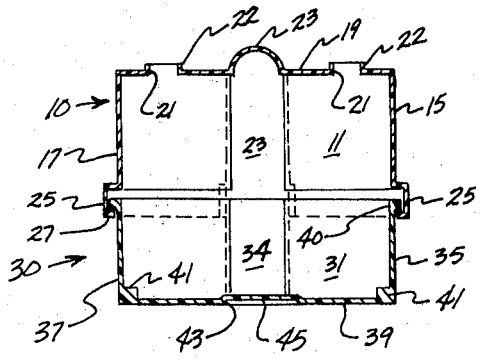
Fig. 3.
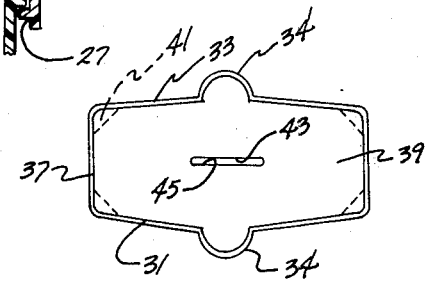
Fig. 4.
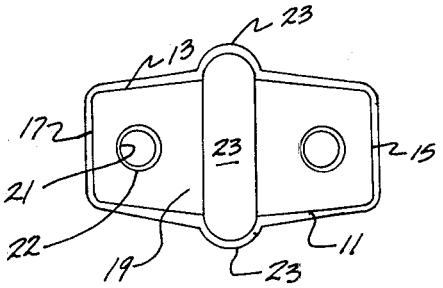
Fig. 5.

LOCK COVER

BACKGROUND OF THE INVENTION

The present invention relates to a cover for a padlock which is intended to be used in environs where the lock could come into contact with water, mud, dirt, dust, snow, salt and the like, which would cause damage to the lock if same is not properly protected. The cover of the present invention is therefore intended to protect the padlock from the elements insofar as the operative elements are concerned. Primarily the cover of the present invention is intended to be received around a padlock that is used in conjunction with a chain device to secure a spare tire to a truck, pickup or the like whereby theft of same is thwarted. Normally the spare tire is mounted exterior to the vehicle where the lock is continuously exposed to the elements.

Different types and styles of covers have heretofore been proposed and used around padlock bodies to protect same from the elements. Such covers have generally been made of flexible materials such as rubber, molded plastic or the like, and the majority of same are provided as two pieces that interconnect somewhere along the height of the lock body, with the top portion having appropriate openings for receiving the legs of the lock shackle.

Exemplary of the prior art which is generally directed to covers of the type mentioned above include U.S. Pat. Nos. 1,662,612 to Junkunc; 2,541,638 to Clevett; 3,848,440 to Manuel; 3,983,725 to Manuel; and 104,441 to Gale; Austrian Pat. No. 154,804 to Spitzer, and German Pat. No. 395,613 to Damm et al.

Though each of the above referred to prior art patents shows a lock cover of the same general type as the cover of the present invention, each alone or in combination is deficient in some fashion in teaching or suggesting the lock cover of the present invention. In particular, the lock cover of the present invention represents an improvement in the art, in that, the present cover better protects a padlock than those covers of the prior art, whereby the useful life of the lock is extended.

SUMMARY OF THE INVENTION

It is an object of the present invention to provide an improved cover for a padlock.

Another object of the present invention is to provide an improved cover for a padlock to protect same from the elements during its normally intended use.

Still further, another object of the present invention is to provide an improved cover for a padlock that is capable of accommodating minor variation in the size of the padlock without loss of the snug fitting relationship of the cover around the body of the lock.

Still further, another object of the present invention is to provide an improved cover for a padlock for use in conjunction with a chain or cable to secure a vehicle spare tire to a portion of the exterior of the vehicle.

Generally speaking, the improved cover assembly for a padlock according to the teachings of the present invention to protect the operative elements of the padlock from the elements comprises a bottom cover portion to be received around a lower portion of the lock body, said bottom cover portion having a bottom wall with an elongate thin wall membrane section therein, said bottom wall having means associated therewith to space a lower end of a lock body therefrom, said bottom cover portion further having connector means thereon; and a top cover portion to be received around an upper portion of the lock body, said top cover portion having connector means thereon mateable with connector means on said bottom portion to removably secure said top and bottom portions around said lock body and enclose same, said top cover portion having a top wall defining two spacially separate lock shackle leg receiving openings, said openings receiving said lock shackle legs in a snug fitting relationship, said top cover portion further having means thereon to permit variation of the space between said shackle receiving openings, whereby the snug fitting relationship between the openings per se and a shackle leg is maintained when small variation exists in the space between the shackle legs, or in lock body dimensions.

More specifically, since it is a primary object of the present invention to provide a cover for a padlock to protect same from the elements such as water, mud, dirt, dust, snow, salt and the like where the padlock is constantly exposed to the elements, it is very important to provide a cover that is to remain generally water tight, whereby the lock will still be protected in the event of minor deviation in lock body or shackle dimensions. Primarily, while the general body of the lock cover of the present invention is adequate to accomplish its intended purpose, often there is minor variation in the distance between the legs of the lock shackle or in the general width of the lock body, such that, unless proper precautions are taken, the top and possibly even the bottom cover portion of the cover assembly will be distorted sufficient to produce a space between the shackle receiving opening and the shackle which would permit the ingress of water, dirt, mud and the like. In order to preclude such, the lock body cover is provided with an expandable section which will permit expansion or contraction, depending upon the space variance, of the lock body, particularly around the shackle receiving openings, whereby with the variation noted above, the snug, generally water tight relationship will continue to exist between the shackle receiving opening and the legs of the lock shackle.

In order to permit size variation of the lock body as noted above, it is necessary that the materials from which the body is constructed be capable of expansion or contraction, at least insofar as the expandable section is concerned. Preferably, however, the entire lock body, both bottom and top are molded of a thermoplastic, synthetic polymeric material which is and of itself has adequate flex to permit the necessary expansion or contraction so long as the expandable body section is provided. Moreover, when the bottom body section of the lock cover is molded of a thermoplastic, synthetic polymeric material, the thin wall section that forms a membrane over the lock passageway of the lock, once ruptured by the insertion of a key into the key passageway, will for all practical purposes, self seal once the key is withdrawn, again leading to improved covering power of the lock during its intended use.

BRIEF DESCRIPTION OF THE DRAWINGS

FIG. 1 is a side elevational view of a lock cover according to teachings of the present invention.

FIG. 2 is an end elevational view of the lock cover as shown in FIG. 1.

FIG. 3 is a cross-sectional view of the lock cover as shown in FIG. 2, taken along a line III—III.

FIG. 4 is a bottom plan view of a lock cover according to teachings of the present invention.

FIG. 5 is a top plan view of a lock cover according to teachings of the present invention.

FIG. 6 is a partial cross-sectional view of a lock cover according to the present invention, illustrating in more detail the connector means as shown in FIG. 3.

DESCRIPTION OF THE PREFERRED EMBODIMENTS

Referring to the Figures, preferred embodiments of the present invention will now be described in detail. In FIGS. 1 through 5, a two part lock cover is illustrated that is generally made up of a top cover portion generally indicated as 10, and a bottom cover portion generally indicated as 30. Top cover portion 10 is made up of connected side wall portions 11 and 13 and end wall portions 15 and 17, all of which are secured to and depend from a top wall portion 19. Top wall 19 has a pair of spaced apart shackle receiving openings 21 located therein, each of which has a sleeve element 22 extending upwardly therefrom, above top wall 19. Top wall 19 and side walls 11 and 13 are provided with an expandable section 23 located thereon which, in a preferred embodiment, is a generally U-shaped wall section that protrudes from the normal contour of the top and side walls and permits expansion or contraction of the top and side walls in a direction parallel to shackle receiving openings 21. Depending upon the flexibility of the material of construction for the lock cover, the wall thickness of the expandable section 23 may vary to achieve the desirable expandable-contractible characteristics. An outer free end of side walls 11, 13, 15 and 17 has an outwardly and downwardly depending skirt portion 25 extending therearound, with an internal bead 27 therewithin. Skirt portion 25 and bead 27 both preferably extend around the periphery of top cover portion 10 and serve as a connector means to permit top cover portion 10 to be removably securable to bottom cover portion 30.

Bottom cover portion 30 is comprised of connected side walls 31 and 33 and end walls 35 and 37, each of which is secured to a bottom wall 39 and extend upwardly therefrom, to receive a lower portion of a lock body therewithin. Bottom cover portion 30 is provided with lock support means such as shoulders 41 which engage the body of lock L and hold same out of contact with bottom wall 39, the purpose for which will be explained hereinafter. Bottom wall 39 further has an elongated portion 43 therein which has a thin wall or membrane coverning 45 thereover. Elongated thin wall portion 43 is so located on bottom wall 39 as to be generally aligned with a key passageway (not shown) in the lock L to be received within bottom cover portion 30. When it becomes necessary to insert a key into the key passageway, the key is forced against elongated thin wall portion 43, ruptures membrane 45 and passes into the key passageway of the lock. Thereafter, upon removal of the key from the key passageway, membrane 45 effectively recloses elongated thin wall portion 43 to further protect lock L from the elements. Connected side walls 31, 3, 35 and 37 of bottom cover portion 30 are provided with connector means, shown as a lip 40 around an upper free end thereof, with lip 40 preferably extending completely around the periphery of bottom cover portion 30. Likewise in a preferred arrangement, side walls 31 and 33 have an expandable wall section 34 along same, with expandable sections 23 and 34 being generally in vertical alignment. When bottom cover portion 30 is placed around the lower portion of the body of lock L, and top cover portion 10 placed over the upper portion of the lock body, skirt portion 25 of the side walls of upper cover portion 10 pass over lip 40 of lower cover portion 30, with lip 40 being held between an inside wall of skirt 25 and bead 27. The two cover portions are thus removably secured around the lock body.

With the upper and lower cover portions 10 and 30, respectively, received around the lock body, and with the shackle legs 51 and 53 received within openings 21 and being in snug fitting, generally water tight relationship by virtue of collars 22, lock L is protected from the elements. As mentioned above, should the space between shackle legs 51 and 53 vary from the norm, or the width of the lock body vary, expandable wall sections 23 and 24 will expand or contract to accommodate same, whereby the snug, generally water tight relationship maintained between collars 22 of openings 21 and leg shackles 51 and 53 remains in tact. In like fashion, with the lower end of the lock L being held off bottom wall 39 by shoulders 41, any dirt, water or the like that would pass through the opening in membrane 45 after a key has been inserted is not likely to enter into the mechanism of lock L, whereby lock L is further protected from the elements.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. An improved cover for a padlock to protect the body of same from the elements comprising:

(a) a bottom cover portion to be received around a lower portion of the lock body, said bottom cover portion having a bottom wall with an elongated thin wall membrane section therein, said bottom wall having means associated therewith to space a lower end of a lock body therefrom; said cover portion further having connector means thereon; and (b) a top cover portion to be received around an upper portion of the lock body, said top cover portion having connector means thereon mateable with connector means on said bottom portion to removably secure said top and bottom portions around said lock body to enclose same, aid top cover portion having a top wall defining two spacially separate shackle leg receiving openings, said openings receiving said shackle legs in a snug fitting relationship, said top cover portion further having means thereon to permit variation of the space between said shackle receiving openings, whereby the snug fitting relationship between the openings and the shackle legs is maintained when small variation exists in space between the shackle legs.

2. The lock cover as defined in claim 1 wherein the top and bottom portions are each of unitary construction from a flexible thermoplastic polymeric composition.

3. The lock cover as defined in claim 2 wherein the thin walled membrane section in said bottom wall may be punctured by a key to operate the lock, and will reclose after removal of the key therefrom.

4. The lock cover as defined in claim 3 wherein the means to separate a bottom of a lock body from the bottom wall of the cover is a plurality of shoulders of unitary construction with said bottom wall and extending upwardly therefrom.

5. The lock cover as defined in claim 4 wherein one of the connector means on said top and bottom portions is a lip extending around the portion and the other is a section defining a lip receiving recess.

6. The lock cover as defined in claim 5 wherein the shackle receiving openings in said top wall have collar members of unitary construction with said top wall and extending upwardly therefrom.

7. The lock cover as defined in claim 6 wherein the means to permit variation of the space between the shackle receiving openings comprises a wall section protruding outwardly from the normal surface of the cover, said wall section having a predetermined width and wall thickness to permit contraction or expansion, said wall section extending along top and side walls of the top cover portion.

8. The lock cover is defined in claim 7 wherein further the wall section extends along the side walls of the bottom cover portion.

* * * * *